US006664720B2

(12) United States Patent
Schult et al.

(10) Patent No.: US 6,664,720 B2
(45) Date of Patent: Dec. 16, 2003

(54) TEMPERATURE COMPENSATED GUN

(75) Inventors: Holger Schult, Montoursville, PA (US); John Cipolla, Trout Run, PA (US)

(73) Assignee: L-3 Communications Corporation, San Carlos, CA (US)

( * ) Notice: Subject to any disclaimer, the term of this patent is extended or adjusted under 35 U.S.C. 154(b) by 50 days.

(21) Appl. No.: 09/839,207

(22) Filed: Apr. 23, 2001

(65) Prior Publication Data

US 2002/0153818 A1 Oct. 24, 2002

(51) Int. Cl.[7] ..... H01J 23/65
(52) U.S. Cl. ..... 313/293; 313/257; 313/447
(58) Field of Search ..... 313/293, 257, 313/447, 456, 270, 451; 315/5.37, 390

(56) References Cited

U.S. PATENT DOCUMENTS

| | | | | |
|---|---|---|---|---|
| 3,963,955 A | * | 6/1976 | Miram et al. | 315/5.34 |
| 4,096,406 A | | 6/1978 | Miram et al. | |
| 4,263,528 A | | 4/1981 | Miram | |
| 4,695,760 A | | 9/1987 | Anthony et al. | |
| 4,745,326 A | * | 5/1988 | Greene et al. | 313/346 |
| 5,317,233 A | | 5/1994 | Lien et al. | |
| 5,589,736 A | | 12/1996 | Lien et al. | |
| 5,629,582 A | * | 5/1997 | Dobbs | 313/456 |
| 5,990,622 A | | 11/1999 | Schult et al. | |

FOREIGN PATENT DOCUMENTS

| | | |
|---|---|---|
| EP | 0673052 A2 | 9/1995 |
| EP | 0957504 A2 | 11/1999 |
| EP | 0957505 A2 | 11/1999 |
| FR | 2775117 | 2/1998 |
| FR | 2775118 | 2/1998 |
| JP | 60-28137 | 2/1985 |
| JP | 62222544 | 9/1987 |
| JP | 02192643 | 7/1990 |

* cited by examiner

*Primary Examiner*—Alexander Gilman
(74) *Attorney, Agent, or Firm*—Lowe Hauptman Gilman & Berner, LLP

(57) ABSTRACT

The invention relates to linear beam amplification devices having an electron emitting cathode and an RF modulated grid closely spaced therefrom, and more particularly, to a novel support structure for the grid that accommodates thermal expansion while maintaining an optimum grid-to-cathode spacing.

13 Claims, 3 Drawing Sheets

TEMPERATURE COMPENSATED GUN

FIELD OF THE INVENTION

The present invention relates to cathode-grid assemblies for linear beam microwave vacuum tube devices having an electron emitting cathode and a microwave modulated grid closely spaced therefrom, and more particularly, to such an assembly including a support structure for the grid, wherein the support structure accommodates differential thermal expansion of a cathode assembly and the grid while maintaining an optimum grid-to-cathode spacing.

BACKGROUND OF THE INVENTION

It is well known in the art to utilize a linear beam microwave vacuum tube device, such as a klystron or traveling wave tube amplifier, to generate or amplify high frequency, microwave RE energy. Such devices generally include an electron emitting cathode, an anode spaced therefrom, and a grid positioned in an inter-electrode region between the cathode and the anode. Grid to cathode spacing is directly related to the performance and longevity of the linear beam device. A problem that has long existed in the art is that during initial heat up, the grid to cathode spacing changes as the cathode is heated, thereby causing performance and reliability problems.

Prior solutions to this problem suggested a grid support structure that is closely connected to the cathode button. These solutions however required complicated mechanical means to deal with the different radial thermal expansion of cathode and grid. In order to electrically insulate the cathode and the grid a plurality of ceramic members was needed to connect the grid to the cathode button. These ceramic members create a plurality of difficulties because the ceramic members are mechanically stressed from the expansion difference. Thus, it would be very desirable to provide a cathode support structure for a linear beam device that maintains a proper spacing between the cathode and grid across the operating temperature range of the device. It would be further desirable to provide such a grid support structure which is formed of a one-piece ceramic. Further, some cases are known where the cathode support cylinder has changed its shape over time due to thermal stress by many heat cycles. In a grided tube with a grid support independent from the cathode button this would cause the cathode to short out with the grid or at least change the initial cathode grid spacing. In both cases the tube will fail early.

SUMMARY OF THE INVENTION

In accordance with one aspect a grid support structure maintains a proper grid-to-cathode spacing across an operating temperature range of the linear beam device.

Another aspect of the present invention also provides a cathode grid connection that allows the grid to follow all cathode movements.

In one aspect of the present invention a linear beam device has an axially centered cathode and an anode spaced therefrom. The anode and cathode are operable to form and accelerate an electron beam. The linear beam device includes an axially centered grid positioned between the cathode and the anode. The grid is operable to accept a high frequency control signal to density modulate the electron beam. A grid support is in contact with the cathode and the grid and keeps the spacing between the cathode and the grid constant, while electrically insulating them.

It is another aspect of the present invention to provide a linear beam device having a cathode and an anode. A linear beam device includes a grid positioned at a predetermined distance from the cathode between the cathode and the anode. The grid is operable to accept a high frequency control signal to density modulate a beam. A grid support supporting the grid which is operable to maintain the predetermined distance between the cathode and the grid throughout the operating temperature range of the linear beam device.

Still other objects and advantages of the present invention will become readily apparent to those skilled in the art from the following detailed description, wherein the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawings and description thereof are to be regarded as illustrative in nature, and not as restrictive.

BRIEF DESCRIPTION OF THE DRAWINGS

The present invention is illustrated by way of example, and not by limitation, in the figures of the accompanying drawings, wherein elements having the same reference numeral designations represent like elements throughout and wherein.

DETAILED DESCRIPTION OF THE INVENTION

The present invention satisfies the need for a grid support structure for a linear beam microwave vacuum tube device that maintains a proper spacing between the cathode and grid across the operating temperature range of the device. It should be understood that although terms such as "above" and "below" are used herein, these terms are to be interpreted in the relative sense as the linear beam device or temperature compensated gun is usable in any orientation.

Figure 1:
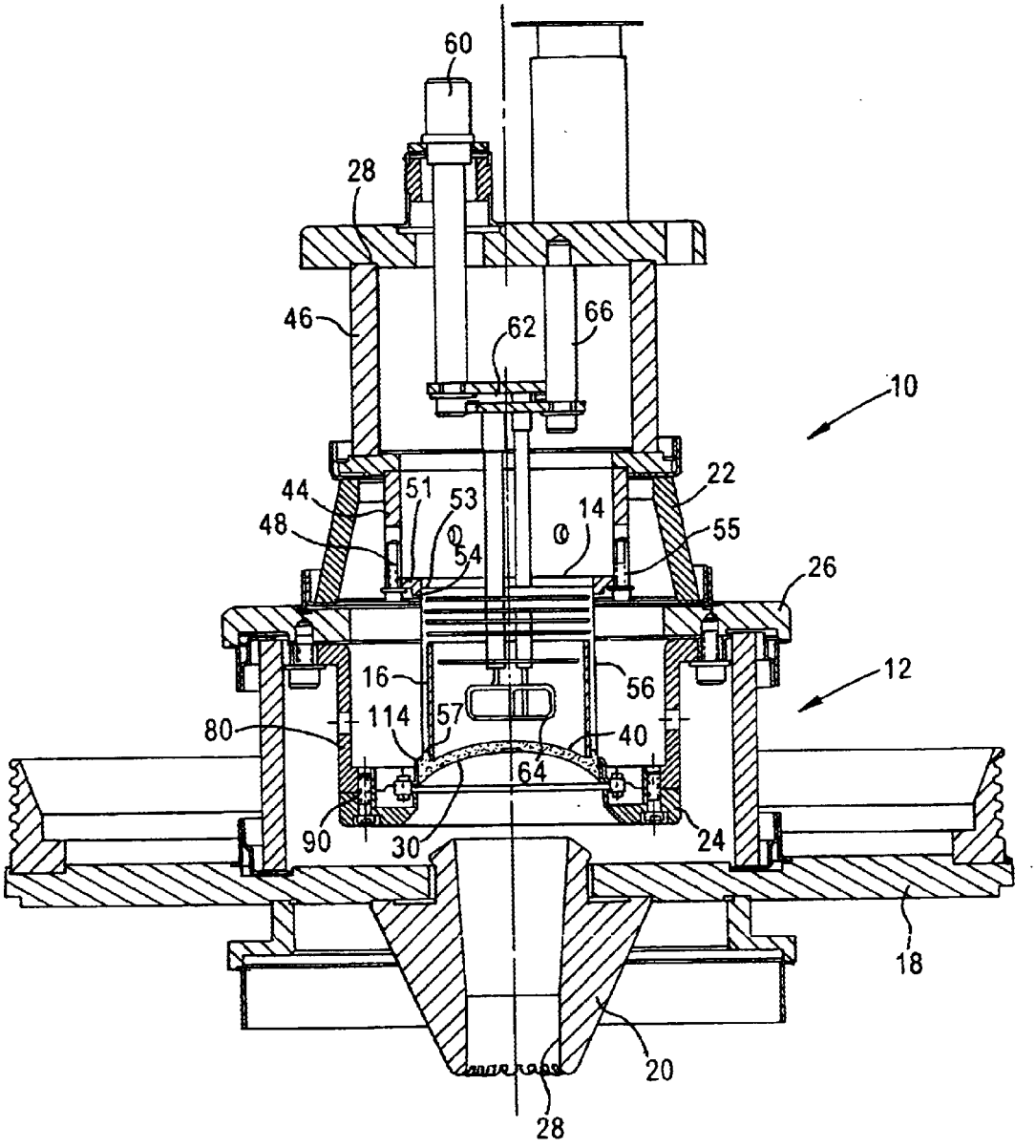
FIG. 1 is a side cross-sectional view of a temperature compensated gun according to a preferred embodiment of the present invention.

Referring first to FIG. 1, the temperature compensated gun of a linear beam device, generally indicated at 10, is illustrated according to the present invention. Because the gun operates conventionally, and the arrangement of the gun is known to one of ordinary skill, other than the inventive grid support structure of the present invention, the gun and the components illustrated in FIG. 1 will only be described briefly and generally.

As illustrated in FIG. 1, linear beam microwave vacuum tube device 10 includes a temperature compensated gun, i.e., cathode-grid, assembly, generally indicated at 12, a heater assembly 14, a cathode assembly 16, a planar anode-pole flange 18 connected to an anode-drift tube 20, an input ceramic 22, a focus ring 24, a grid connection 26 and a cathode support connection 28. The heater assembly 14 extends into the cathode assembly 16 without touching it. The anode includes a central aperture, and by applying a high voltage potential between the cathode 40 and the anode-pole flange 18, electrons can be drawn from the cathode surface and directed into a high power beam that passes through the anode aperture. Gun 12 is particularly useful in one class of linear beam microwave vacuum tube devices, referred to as an inductive output tube (IOT) which includes a grid 30 disposed in the inter-electrode region between the cathode 40 and the anode 20. The electron beam can thus be density modulated by applying an RF signal to the grid 30 relative to a cathode 40. As the density modulated beam is accelerated to the anode and propagates across a gap provided downstream within the TOT, RF fields are induced into a cavity coupled to the gap. The RF fields can then be extracted from the cavity in the form of a high power, modulated RF signal. An example of an TOT is disclosed by U.S. Pat. No. 5,650,751 to R. S. Symons, entitled "INDUCTIVE OUTPUT TUBE WITH MULTISTAGE DEPRESSED COLLECTOR ELECTRODES PROVIDING A NEAR-CONSTANT EFFICIENCY," the subject matter of which is incorporated in the entirety by reference herein.

Figure 2:
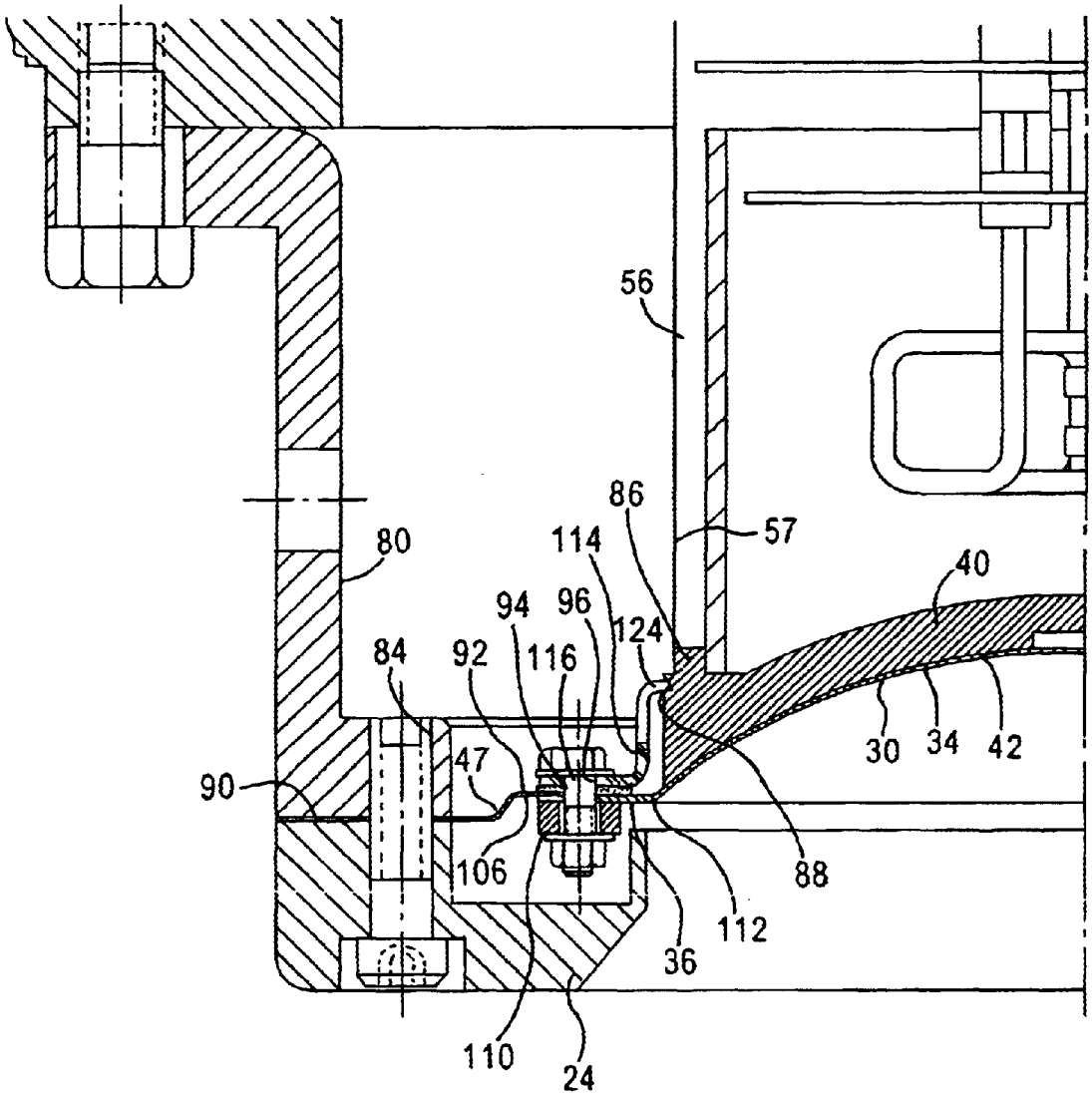
FIG. 2 is an enlarged cross-sectional view of the cathode-grid assembly of the gun of FIG. 1.
Figure 3:
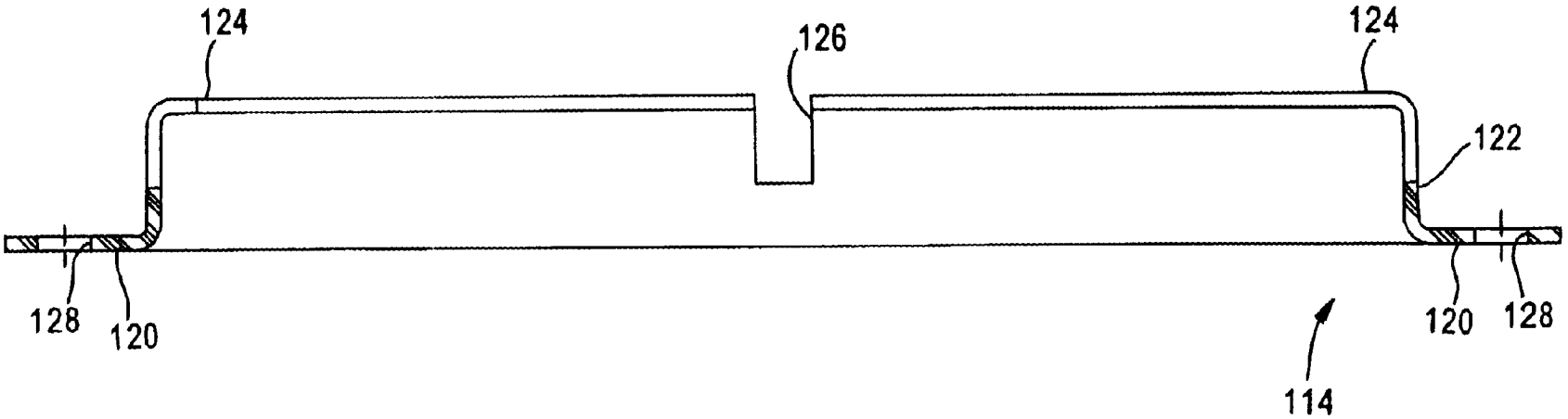
FIG. 3 is a side cross-sectional view of the grid support of FIGS. 1 and 2.

A grid support structure is illustrated in FIGS. 1–3, in which the linear beam microwave vacuum tube device 10 includes the axially centered grid 30 disposed in close proximity to the cathode 40. To permit high RF voltage and high RF gain, it is desirable to space the grid 30 close to the cathode 40 surface. The grid support structure prevents, during start-up, the cathode 40 from moving toward the grid 30. If the cathode 40 moves toward the grid 30, then: 1) a change in perveance occurs during heat-up; 2) there is a possibility to short out the cathode and the grid; and 3) there is a variance in perveance. More particularly, the axially centered grid 30 is operable to accept a microwave high frequency control signal to density modulate an electron beam emitted by the cathode 40. The grid 30 comprises a central active portion 34 and a peripheral portion or grid flange 36 with the peripheral portion comprising a plurality of evenly spaced mounting holes. The grid 30 is comprised of pyrolytic graphite material. The cathode 40 comprises a concave electron emitting surface 42 and the active portion 34 of the grid comprises a concave shape that corresponds with the emitting surface 42. The concave electron emitting surface 42 and the grid 30 are concentric spheres, having the same center so that the grid 30 and emitting surface 42 are generally parallel to each other. The grid 30 is secured in place by a grid support structure (described below). The grid flange 36 is flat and lies in a plane that is substantially normal to the axis of the electron beam emitted by the cathode 40.

The cathode assembly 16 is bolted to a cylindrical lower support 44 which in turn is connected to an upper support 46. The lower support 44 has a plurality of threaded bolt holes 48 and is connected to a cathode flange 51 through corresponding bolt holes 55 in the cathode flange 51. The cathode flange 51 has an annular recess 53 which receives one end 54 of a cylindrical molybdenum cylinder 56. The end 54 of the molybdenum cylinder 56 is brazed to the recess 53 of the cathode flange 51. An opposite end 57 of the molybdenum cylinder 56 is brazed to the cathode 40. Since it is desirable to space the grid 30 closely to the cathode 40 surface, the grid 30 must be capable of withstanding very high operating temperatures. In view of these demanding operating conditions, it is known to use pyrolytic graphite material for the grid 30 due to its high dimensional stability and heat resistance. The pyrolytic graphite grid 30 may be made very thin, with a pattern of openings formed therein, such as by conventional laser trimming techniques, to permit passage of the electron beam therethrough. Because of the low coefficient of expansion of the pyrolytic graphite, heating of the grid 30 (by direct thermal radiation from the cathode 40 and by dissipation of RE drive power applied between the cathode 40 and grid 30) does not cause the grid 30 to expand into the cathode 40 and short circuiting of these two elements does not occur. As a result, the grid 30 can be positioned very close to the cathode 40 surface 42, permitting high RE drive voltage and high gain. Nevertheless, a practical limitation on the efficiency of such linear beam devices has been the difficulty of supporting the cathode 40 in a proper position relative to the grid 30.

Heater assembly comprises an insulated flange package 62 connected to two posts (one has heat shields). Posts are connected to a heating element 64. The flange package is bolted to a heater connection 60 (upper flange) and a "ground" connection 66 (lower flange) which is at cathode potential. The heating element 64 is spaced from the cathode 40. The grid 30 is mechanically connected through the grid support 114 to the cathode 40 and moves together with the cathode 40 as the cathode assembly expands.

As previously mentioned, in a linear beam device, such as a microwave electron beam vacuum tube with a gun, driven with RF applied to a grid, the spacing between the cathode 40 and the grid 30 must be precisely maintained because the spacing is in the range between 0.005 and 0.010 inches; this spacing is necessary to make the tube work at microwave frequencies, e.g., close to 1 GHZ, i.e., the grid to cathode spacing is a fraction of a wavelength of the tube operating frequency.

In operation, when the tube operation is started the cathode 40 is heated and expands towards the grid 30. As depicted in FIG. 1, for example, the molybdenum cylinder 56 expands when the heating elements 64 are energized. Because the cathode 40 is rigidly connected to molybdenum cylinder 56 during a transient heat up condition, the grid cathode spacing would change if the cathode 40 were to move toward the grid 30. If such movement is not prevented, the heating would cause a change in the cathode 40 to grid spacing if the grid support structure is not closely connected directly to the cathode 40. The change in spacing would disadvantageously cause:

(1) A change in perveance during heat up. Applying constant beam and grid voltage the beam current would change during the first 15 to 20 minutes of operation after applying heater voltage. For many tube applications this long waiting time to get stable operation is unacceptable so that the only other solution is to constantly preheat the cathode (=stand by). This causes a constant evaporation of barium from the cathode 40 and limits the lifetime of the gun 10. In many applications it would be desirable to reduce the total heat up time to less than five minutes.

(2) A possibility to short out the cathode 40 and the grid 30. Especially in applications where the cathode 40 temperature is variable due to a variable heater voltage, cathode 40 might expand into the grid 30 to cause a short circuit between them. This will immediately damage both cathode 40 and the grid 30 and must be avoided. Tubes with tungsten dispenser type cathodes can usually be recovered from weak emission by overheating the cathode for the regeneration of barium on its surface. In the case of a tube with a grid, however, overheating might cause the cathode 40 to expand more than the gun was designed for and short out with the grid. This means that the useful tool of overheating the cathode cannot be used for a grided electron beam tube with small cathode to grid spacing.

(3) A variation in perveance depending on the cathode 40 temperature. As described with regard to the change in perveance during heat up, the expansion of the cathode 40 would decrease the spacing between cathode and grid. In many applications it is desirable to vary the cathode heating during the lifetime of the tube to optimize the barium production of the cathode and by this stabilize and secure the emission. Within the first couple hundred hours of operation the cathode should be heated slightly more to stabilize the barium production. Once the barium production is stable enough the cathode can be operated at lower temperature to evaporate less barium. This increases the lifetime of the cathode. When the tube reaches the end of its lifetime many operation hours can be added by increasing the cathode temperature to activate more barium. This procedure is well known for television klystrons and many other electron beam tubes. However, it is difficult or impossible to apply this procedure to a grided tube if the spacing between cathode and grid depends on the cathode temperature. So it is desirable to have a grided gun with constant cathode to grid spacing.

The electrical and mechanical connections of the grid 30 to cathode 40 via grid support structure 114 are illustrated in detail in FIG. 2. A copper foil 90 is disposed between a grid connection support 80 and the focus ring 24. The thin copper foil 90 is used to provide electrical contact to the grid 30 through the grid connection support 26 (FIG. 1) and the grid connection support 80. The copper foil 90 also has a plurality of evenly-spaced holes aligned with holes 84 of the grid connection support 80. Tightening of the bolts 91 holding the focus ring 24 to the holes 84 in the grid connection support 80 compresses the copper foil 90 so that the foil conforms to support 80 and ring 24. During high temperature "bake-out" of the linear beam device 10, the copper foil 90 softens to reduce internal stress. The copper foil 90 has a portion 92 which extends inwardly and which has a plurality of substantially evenly spaced holes 94. The foil is bolted together by bolts 96 with the grid flange 36 and the grid support 114 through corresponding bolt holes. The copper foil 90 provides for expansion and is flexible and has a fold or stepped portion 97 to provide for cathode 40 movement. For better heat transfer, the copper foil 90 can be constructed from a plurality of foils. An inner portion 98 of the copper foil 90 is positioned radially inwardly from bolts 96 and is clamped between a grid cover ring 110 and a flange 120 of grid support 114 together with the grid flange 36. Disposed below and adjacent to a lower surface 106 of the stepped portion 97 is an upper surface 112 of the grid flange 36 of the grid 30. The grid cover ring 110 is positioned below a lower surface 112 of the grid flange 36. The grid cover ring 110 is made of a glassy carbon. The grid cover ring 110 could be left out if the grid flange 36 is thick enough to distribute the bolt 96 force evenly enough to get good contact between the grid flange 36 and the copper foil 90. Also, instead of the glassy carbon, one could use small segments of stainless steel or any other metal or ceramic. Glassy carbon was chosen because it has the same expansion coefficient as the grid 30 and the grid support 114 while it is less expensive than PBN or pyrolytic graphite. The grid cover ring 110 is an annular member having a plurality of bolt holes matching the holes of the grid flange and grid support. The bolts 96 tighten the grid support 114, the copper foil 90, the grid flange 36 and the grid cover ring 110 together.

As depicted in FIGS. 2 and 3, the grid support 114 has an outwardly extending flange portion 120, an intermediate vertically extending portion 122 and an inwardly extending lip 124 which together form a cup-like structure. Four (or more) circumferentially spaced and inwardly extending slots 126 are cut in the inwardly extending lip 124 and partially into the vertically extending portion 122 to provide flexibility in the grid support 114. The cathode 40 has an outer button portion 86 which has an inwardly extending annular groove 88 which receives the lip 124 of the grid support 114.

The grid support 114 is a one-piece ceramic structure to support the grid 30 and directly connect it to the cathode 40. The grid support 114 is made from a pyrolytic boron nitride (PBN) ceramic. The grid support 114 has a cup shape with its bottom removed and has a thin slotted wall that is flexible enough to be clipped to the cathode 40 like a spring. The grid support 114 can also be brazed to the outside diameter of the cathode 40. The slots 126 of the grid support 114 also cause the expanding cathode 40 to only bend the remaining tab formed sections of the cylindrical part of the grid support 114, to prevent substantial stressing of the flange shaped portion. The material provides a minimal heat transfer characteristic so the grid 30 is not additionally heated by conduction. The flexibility and other mechanical properties of PBN are fairly stable up to 2000° C., so that grid support 114 does not substantially change size as a result of operation of device 10. The machinable ceramic is machined to very small tolerances so no structure is necessary to align support 114 axially and radially to the cathode 40. The ceramic of support 114 provides a non-moving, non-expanding mounting platform for the grid 30 that keeps the cathode 40 to grid 30 spacing stable at all temperatures. The surface of vertically extending portion 122 of the grid support 114 facing the grid 30 forms a mounting platform and is shaped as a flange. The flange 120 has a plurality of holes 128 through which the bolts 96 extend. The grid 30 is made of pyrolytic graphite which has nearly the same expansion coefficient as PBN which is used to form the ceramic support 114. Therefore, the grid-ceramic connection remains unstressed at all operating temperatures of device 10. A glassy carbon flange 110 on top of the grid flange 36 provides distribution of the clamping force. The glassy carbon flange could also be formed of thin stainless steel flange sections.

The grid 301 cathode 40 spacing can be adjusted by choosing the right number of shims between the grid rim 36 and ceramic flange 120, i.e., the number of foils 90 between rim 36 and flange 120 determines the spacing between grid 30 and cathode 40. The axial alignment is provided by the holes in the grid rim that are large enough to allow for adjustment before tightening the screws.

During operation of the linear beam device 10, the pyrolytic graphite material of the grid 30 experiences slight thermal expansion. The cathode 40 on the other hand exhibits some thermal expansion in both the axial and radial directions. The material composition of the grid support 114 and the grid 30 and the grid cover ring 110 are selected to have similar coefficients of expansion and thus expand and contract at a uniform rate. As the cathode 40 expands in the radial direction, the grid support 114 flexes outwardly. Thermal expansion in the axial direction is basically caused by the molybdenum cylinder 56. The axial expansion of cylinder 56 moves the cathode 40 together with the grid support 114 and the grid 30 and leaves the cathode 40 to grid 30 spacing basically constant. The only portion of cathode 40 that expands into the grid 30 is the part of the cathode 40 between the grid 30 and the inwardly extending annular groove 88 which is very small and causes only an acceptable variation in spacing.

It will be readily seen by one of ordinary skill in the art that the present invention fulfills all of the objects set forth above. After reading the foregoing specification, one of ordinary skill will be able to affect various changes, substitutions of equivalents and various other aspects of the invention as broadly disclosed herein. It is therefore intended that the protection granted hereon be limited only by the definition contained in the appended claims and equivalents thereof.

What is claimed is:

1. A cathode-grid assembly for a linear beam microwave tube, the assembly and a beam adapted to be derived by the assembly as a result of operation of the tube having a coincident longitudinal axis, the cathode-grid assembly comprising a cathode assembly that expands radially and axially relative to said axis as a result of operation of the tube, a grid made of material that does not expand substantially as a result of operation of the tube, and an electrical insulating structure that is flexible relative to the cathode assembly and made of material that does not expand substantially as a result of operation of the tube, the structure mechanically connecting the grid and cathode assembly together so that the grid is spaced in the direction of the longitudinal axis from an electron emitting surface of the cathode by a fraction of an operating wavelength of the tube, the structure being connected only to peripheral portions of the grid, the material and construction of the structure being such as to maintain the spacing, in the direction of the longitudinal axis, between the grid and the cathode electron emitting surface substantially the same during operation of the tube, wherein the structure is made of pyrolytic boron nitride, wherein the structure includes: (a) a thin wall extending in the direction of and spaced from the longitudinal axis, (b) a first flange extending radially inward from the wall, and (c) a second flange extending radially outward from the wall, the first flange having an end remote from the wall fixedly connected to a cylindrical surface of the cathode assembly, the second flange being fixedly connected to the grid.

2. The assembly of claim 1 in combination with the microwave tube.

3. The assembly of claim 1 wherein the structure is carried by the cathode assembly and carries the grid.

4. The assembly of claim 1 further including a metal foil between the structure and the grid, the metal foil having a thickness in the direction of the axis.

5. The assembly of claim 1 further including a plurality of stacked metal foils between the structure and the grid, each of the metal foils having a thickness extending in the direction of the longitudinal axis.

6. The assembly of claim 1 wherein the first flange includes plural radially extending slots connected to corresponding slots in the wall.

7. The assembly of claim 6 wherein the structure is carried by the cathode assembly and carries the grid.

8. The assembly of claim 7 in combination with the microwave tube.

9. A cathode-grid assembly for a linear beam microwave tube, the assembly and a beam adapted to be derived by the assembly as a result of operation of the tube having a coincident longitudinal axis, the cathode-grid assembly comprising a cathode assembly that expands radially and axially relative to said axis as a result of operation of the tube, a grid made of material that does not expand substantially as a result of operation of the tube, and an electrical insulating structure that is flexible relative to the cathode assembly and made of material that does not expand substantially as a result of operation of the tube, the structure mechanically connecting the grid and cathode assembly together so that the grid is spaced in the direction of the longitudinal axis from an electron emitting surface of the cathode by a fraction of an operating wavelength of the tube, the structure being connected only to peripheral portions of the grid, the material and construction of the structure being such as to maintain the spacing, in the direction of the longitudinal axis, between the grid and the cathode electron emitting surface substantially the same during operation of the tube, wherein the structure is made of flexible ceramic material and includes: (a) a thin wall extending in the direction of and spaced from the longitudinal axis, (b) a first flange extending radially inward from the wall, and (c) a second flange extending radially outward from the wall, the first flange having an end remote from the wall fixedly connected to a cylindrical surface of the cathode assembly, the second flange being fixedly connected to the grid.

10. The assembly of claim 9 further including a metal foil between opposed surfaces of the second flange and the grid, the metal foil having a thickness extending in the direction of the longitudinal axis.

11. The assembly of claim 9 further including a plurality of stacked metal foils between opposed surfaces of the second flange and the grid, each of the metal foils having a thickness extending in the direction of the longitudinal axis.

12. The assembly of claim 9 wherein the first flange includes plural radially extending slots connected to corresponding slots in the wall.

13. The assembly of claim 12 wherein the structure is carried by the cathode assembly and carries the grid.

* * * * *